US005469671A

United States Patent [19]

Rathgeber et al.

[11] Patent Number: 5,469,671

[45] **Date of Patent: * Nov. 28, 1995**

[54] ROOF PERIMETER COMPOSITE SECURING ELEMENT AND METHOD OF INSTALLING

[75] Inventors: Juergen O. Rathgeber, Arlington Heights; Frederick A. Kish, Lockport; Syed R. Hasan; Craig A. Hindman, both of Palatine, all of Ill.

[73] Assignee: Illinois Tool Works Inc., Glenview, Ill.

[ * ] Notice: The portion of the term of this patent subsequent to May 10, 2011, has been disclaimed.

[21] Appl. No.: 208,247

[22] Filed: Mar. 9, 1994

Related U.S. Application Data

[63] Continuation of Ser. No. 831,412, Feb. 5, 1992, Pat. No. 5,309,685.

[51] Int. Cl.[6] ..... E04D 1/36

[52] U.S. Cl. ..... 52/58; 52/410; 428/189; 428/906

[58] Field of Search ..... 52/58, 404, 408, 52/410, 698; 428/137, 189, DIG. 906; 156/71, 92

[56] References Cited

U.S. PATENT DOCUMENTS

| | | | |
|---|---|---|---|
| 3,937,640 | 2/1976 | Tajima et al. | 156/71 |
| 4,642,256 | 2/1987 | Sato . | |
| 4,670,071 | 6/1987 | Cooper et al. | 156/71 |
| 4,712,348 | 12/1987 | Triplett et al. . | |
| 4,793,116 | 12/1988 | Whitman . | |
| 4,803,111 | 2/1989 | Mansell . | |
| 4,932,171 | 6/1990 | Beattie . | |
| 4,937,990 | 7/1990 | Paquette . | |
| 4,963,430 | 10/1990 | Kish et al. . | |
| 5,000,999 | 3/1991 | Hollander . | |
| 5,088,259 | 2/1992 | Myers . | |
| 5,139,847 | 8/1992 | Breen . | |
| 5,142,837 | 9/1992 | Simpson et al. . | |

*Primary Examiner*—Lanna Mai
*Attorney, Agent, or Firm*—Schwartz & Weinrieb

[57] ABSTRACT

A composite roof covering securement element is comprised of an elongated rubber membrane onto which a plastic batten strip is adhesively bonded. The membrane and strip have a range of flexibility which permitts the same to be rolled into a coil for manual prepositioning on a roof and then unrolled to lie flat upon the roof for attachment along the perimeter. When installed the composite element resists shear loads and securely retains the overlying roof covering in place.

16 Claims, 2 Drawing Sheets

ROOF PERIMETER COMPOSITE SECURING ELEMENT AND METHOD OF INSTALLING

This application is a continuation of application Ser. No. 831,412, filed Feb. 5, 1992, now U.S. Pat. No. 5,309,685.

FIELD OF THE INVENTION

The present invention relates to a composite roof securement element and a method of installing the composite element to secure a roof covering in place on a roof structure.

BACKGROUND OF THE INVENTION

Examples of prior art in securing coverings to roof structures include U.S. patents:

U.S. Pat. No. 4,885,887

U.S. Pat. No. 4,932,171

U.S. Pat. No. 3,900,102 and Canadian patents:

1,174,024

8,71,960

While differing in several respects from each other, the structure and methods disclosed in these patents require extensive time and labor to install.

A further consideration is the extent to which a roof perimeter fastening system can withstand the forces imposed by winds passing over the roof and, in particular, the shear forces imposed at angles to the perimeter fastening means. For example, it is common practice to secure the perimeter securement elements to the roof structure with a plurality of spaced screw fasteners driven through respective plates or washers. An example is shown in the above mentioned U.S. Pat. No. 4,932,171 wherein a plurality of spaced screws 23 or 32 is utilized. Clearly, force-resistant stresses are concentrated at the spaced fasteners.

In practice, a perimeter securement membrane is positioned on the underlying roof insulation. The plurality of plates or washers are then manually placed on the perimeter membrane at intervals therealong. While the specifications may require that the plates be carefully positioned at a predetermined distance from the wall and at equal distances from each other, the pressures of time or the inexperience of the installers may result in a haphazard pattern not in conformance with the specifications.

SUMMARY OF THE INVENTION

The present invention provides a pre-assembled composite securement element which has the flexibility to be rolled into a coil for convenient manual positioning on the roof and then so as to lie flat on the roof for attachment by suitable fasteners. No plates or washers are involved, with their attendant requirements to be accurately positioned or creating the problems resulting from inaccurate placement. The pre-assembled composite element insures that the fasteners will be installed at predetermined locations in accordance with the applicable specifications; thereby eliminating the conventional haphazard array of plates and fasteners.

The composite securement element includes an elongated (that is, relatively long and narrow) plastic batten strip bonded preferably continuously along its length into connection with an elongated membrane. The continuous bond between the batten strip and membrane enhances the holding strength of the installed securement element. When the roof membrane sheet is glued on top of the securement element, the structure of the batten strip maximizes resistance to shear loads, which are concentrated at the fasteners in the prior art, by distributing the forces along the entire length of the element. Accordingly, the fasteners used with the invention are not the sole resistance to the shear forces.

OBJECTS OF THE INVENTION

It is a primary object of the present invention to provide a securement element and method of installation which substantially reduces time and labor of installation while providing effective resistance to applied forces.

It is another object to provide a roof perimeter securement system wherein the fasteners are attached at predetermined locations thereby eliminating haphazard or non-uniform attachment characteristic of prior systems.

It is another object to provide a perimeter securement element which is preassembled at a manufacturing facility wherein tolerances can be closely held to produce a product of higher quality than can be achieved by prior art systems.

BRIEF DESCRIPTION OF THE DRAWINGS

Various other objects, features, and attendant advantages of the present invention will become more fully appreciated from the following detailed description, when considered in connection with the accompanying drawings, in which like reference characters designate like or corresponding parts throughout the several views, and wherein.

DESCRIPTION OF THE PREFERRED EMBODIMENT

Figure 1:
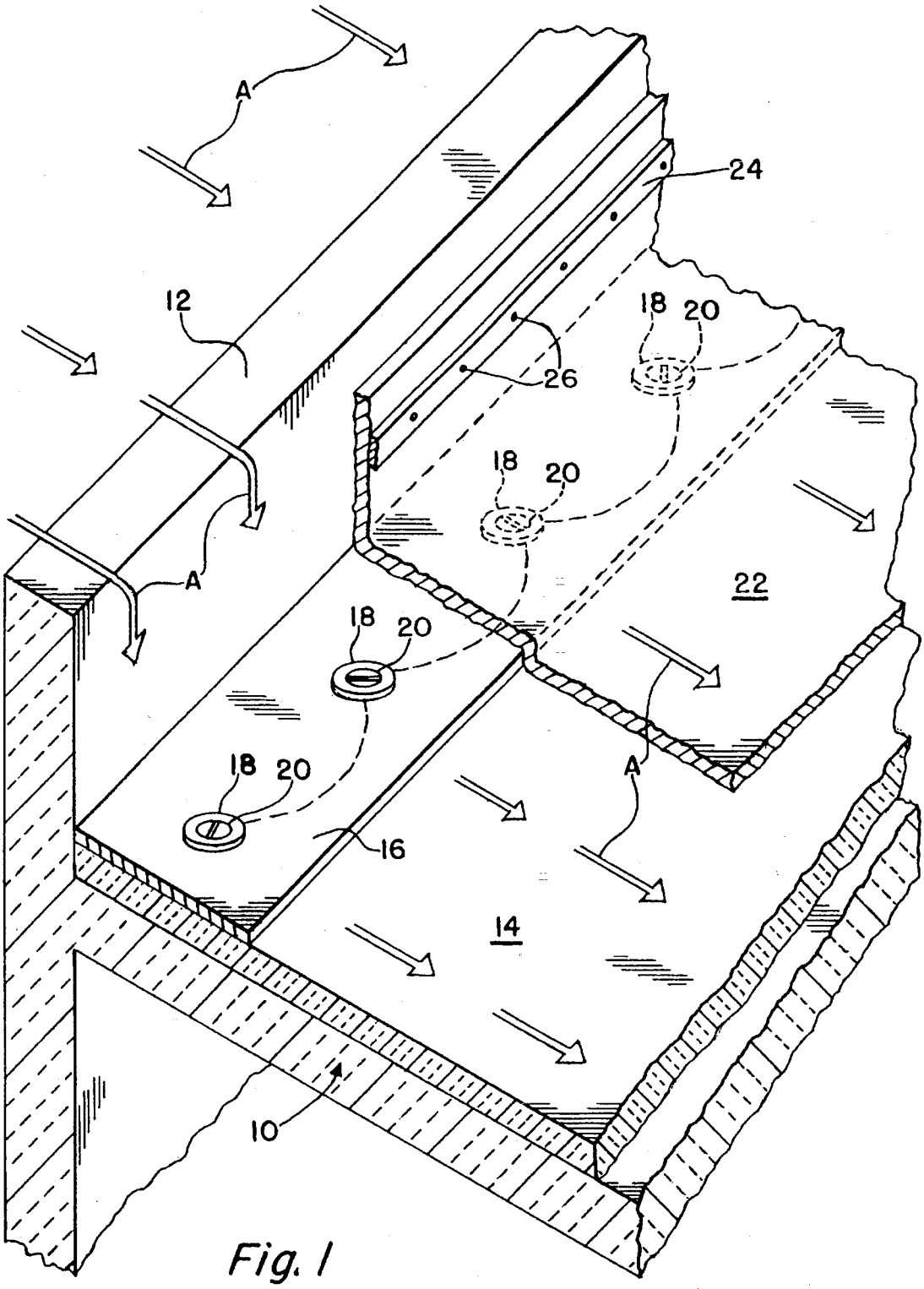
Fig. 1 (Prior Art)
FIG. 1 is a fragmentary perspective view of a roof structure employing perimeter securement of the prior art.

As shown in FIG. 1 a roof structure 10 is disposed adjacent to a parapet wall 12 defining the perimeter of the roof. In practice the roof structure 10 could consist of a variety of well known constructions, but in accordance with the illustrated example, the structure is covered by a layer of pre-formed insulation 14.

In accordance with the prior art shown in FIG. 1, the perimeter of the insulation 14 is secured in place by a means and method to be now described. A perimeter membrane 16 of reinforced polymeric material such as ethylene propylene diene rubber (EPDM) is disposed on the insulation 14 adjacent the wall 12 shown. A plurality of plastic or metal plates 18 is manually placed on the membrane 16 at spaced intervals, hopefully in accordance with specifications for the job regarding distance from the wall and from each other. Suitable screw fasteners 20 are then driven through respective plates 18 so as to secure the membrane 16 and insulation 14 to the roof structure 10.

Typically, the top layer of the completed roof is a sheet or membrane 22 of non-reinforced EPDM glued to the underlying perimeter membrane 16 and secured to the wall 12 by a so-called termination bar 24 which is secured to the wall 12 by suitable fasteners 26.

With the prior art system of FIG. 1, winds blowing over the roof will create so-called shear forces effective on the membrane 22 as shown generally by the arrows A. Since the perimeter membrane 16 is secured by the spaced fasteners 20, the material of the roof membrane 22 above the perimeter membrane 16 will tend to pull and move as depicted generally by the dotted lines extending between the fasteners 20. The forces resisting movement are concentrated at the spaced fasteners and over time can cause enlargement of the holes about the fasteners and induce water leakage as well as peeling of the membrane 22 from the corner and parapet wall 12.

Figures 2, 3:
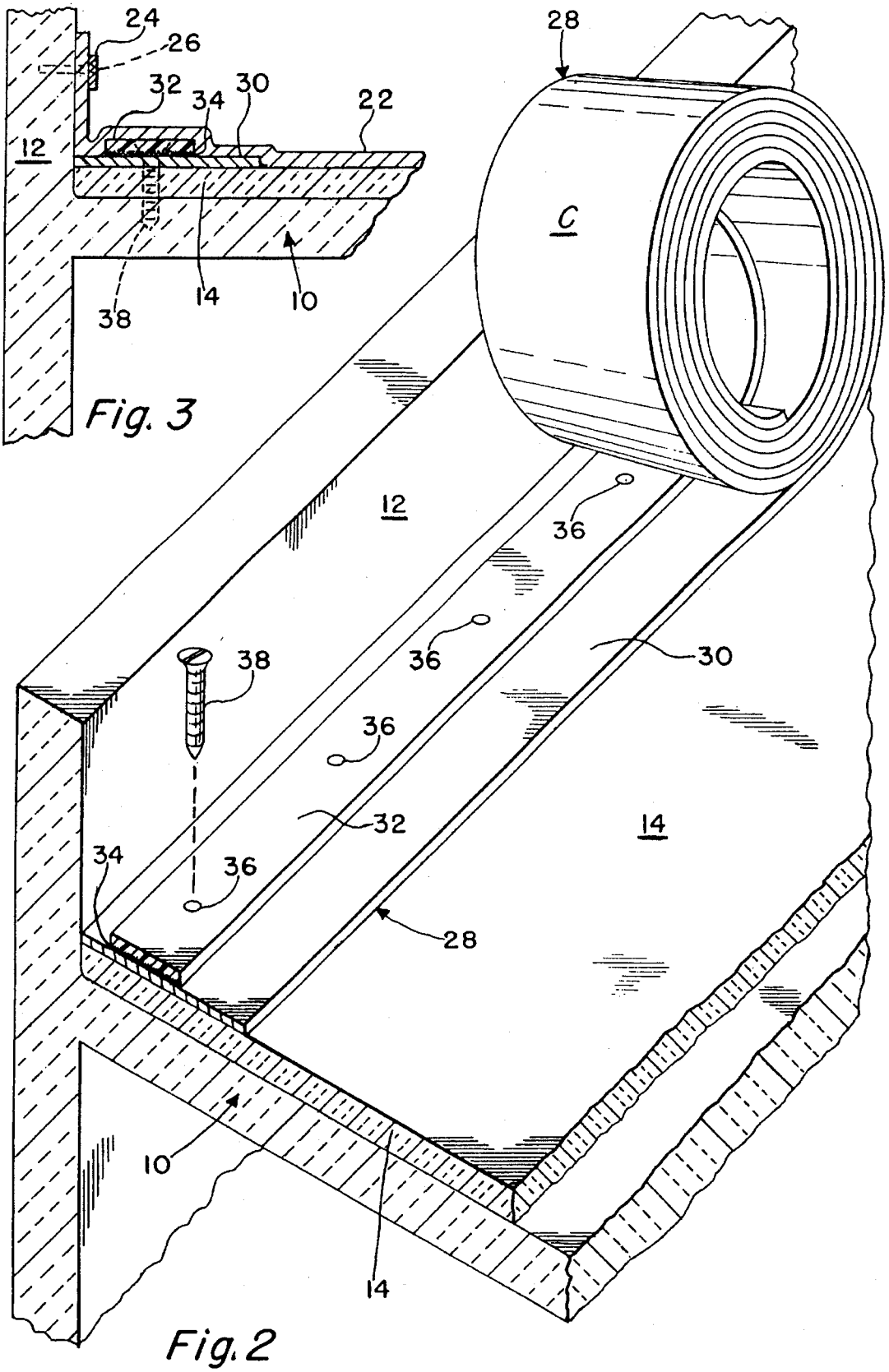
FIG. 2 is a fragmentary perspective view employing the perimeter securement structure and method of the invention.
FIG. 3 is a cross-sectional view of the installed roof system.

The invention is shown in FIG. 2 wherein a composite, pre-assembled perimeter securement element 28 is shown rolled into a coil C disposed adjacent to the wall 12, with an end unrolled along the wall as shown. The element 28 consists of an elastomeric perimeter membrane 30 and a plastic batten strip 32. Preferably, the membrane 30 is a 6" wide strip of EPDM approximately 0.045 inches thick and which may be internally reinforced with a highstrength polyester fabric. Such a membrane is commercially available under the "Rubber Gard" trademark from Firestone Building Products Company of Carmel, Indiana.

The plastic batten strip 32 is preferably a flexible oriented plastic strip 1" wide and 0.050" thick manufactured by the Assignee herein in accordance with the formulation and method disclosed in U.S. Pat. No. 4,963,430, the disclosure of which is hereby incorporated by reference. As set forth in U.S. Pat. No. 4,963,430 the composition of the batten strip may be from about 80 to 97% by weight of polyethylene terephthalate and from about 3 to 20% by weight of a polyolefin and wherein the polyolefin may be polypropylene.

In accordance with the invention, the batten strip 32 is secured preferably continuously along its length to the membrane 30 by an adhesive 34 applied therebetween. The degree of adhesion is sufficient to insure that the membrane and strip will adhere securely throughout handling, installation and final use.

The batten strip 32 is provided with a plurality of fastener-receiving openings 36 drilled or punched therethrough at pre-determined intervals prior to attachment of the strip 32 to the membrane 30. Accordingly when ready for attachment to the roof structure, the composite element 28 can be attached by fasteners 38 driven into the respective openings 36. As an alternative, the strip could be simply marked at the desired spaced intervals whereat the holes could be drilled when the composite securement element is installed on the roof.

The method of installing the composite securement element 28 is simple and virtually fool-proof. The coil C is readily manually disposed along the wall 12 over the roof insulation 14 and then unrolled as shown in FIG. 2. The conjoint flexibility of the membrane 30 and strip 32 enables the resulting composite element to lie flat on the insulation 14 for quick and easy attachment to the underlying roof structure 10 by the fasteners 38. The strip 32 is pre-assembled on the membrane 30 a pre-determined distance from the edges of the membrane 30 so that disposing the edge of the membrane against the wall will automatically position the fasteners a pre-determined distance from the wall.

After quickly and conveniently installing the securement element 28, it will be understood that the roof membrane 22 of FIG. 1 is installed over the element 28 of FIG. 2 and secured to the wall 12 in the same manner-as shown in detail in FIG. 1. The resulting roof structure is shown in FIG. 3. In practice, the underlying securement element 28 is cleaned with a solvent and an adhesive is then applied onto the element 28 along its length. The membrane 22 is thus secured to the composite element 28 continuously along the perimeter of the roof. The bonded connection of the roof membrane 22 to the relatively stiff and strong batten strip 32 prevents the membrane 22 from moving as depicted by the prior art system of FIG. 1. That is, the shear forces are no longer concentrated at the fasteners.

By the foregoing the applicants have created a unique roof perimeter securement system well suited to achieve the objects of the invention.

Obviously, many modifications and variations of the present invention are possible in light of the above teachings. It is therefore to be understood that within the scope of the appended claims, the present invention may be practiced otherwise than as specifically described herein.

I claim:

1. A composite roof securement element, comprising:

a flexible membrane of elastomeric material having a first surface thereof for engagement with a roof substrate; and a flexible batten strip inseparably bonded to a second surface of said flexible membrane so as to extend substantially parallel to and atop said flexible membrane;

said flexible membrane and said flexible batten strip bonded thereto being conjointly flexible so as to permit said flexible membrane and said flexible batten strip bonded thereto to be formed into a coil whereby said coil may be conveniently handled, readily pre-positioned upon said roof substrate, and unrolled into position upon said roof substrate at which said unrolled composite roof element lies flat upon said roof substrate for securement to said roof substrate by fasteners driven through said flexible batten strip and said flexible membrane and into said roof substrate.

2. The element of claim 1, wherein said membrane is a reinforced EPDM rubber and said batten strip is a composition of from about 80 to 97% by weight of polyethylene terephthalate and from about 3 to 20% by weight of a polyolefin.

3. An element as set forth in claim 1, wherein:

said batten strip is bonded to said membrane by means of an adhesive applied continuously along the length of said batten strip such that said batten strip is adhesively bonded to said membrane throughout the juncture defined between said batten strip and said membrane.

4. An element as set forth in claim 1, wherein:

said membrane is approximately six inches (6") wide and 0.045 inches thick; and said batten strip is approximately one inch (1") wide and 0.050 inches thick.

5. A system for securing a weather-proof covering to a roof structure, comprising:

an elastomeric membrane having a bottom surface for engaging an underlying roof structure, and also having an upper surface; and a plastic batten strip inseparably bonded onto said upper surface of said elastomeric membrane so as to form a composite integral structure therewith;

said composite structure having a range of flexibility for permitting said composite integral structure to be rolled into a compact coil for convenient handling, and to be unrolled onto said roof structure so as to lie flat thereon for securement thereto by fasteners driven through said plastic batten strip and said elastomeric membrane and into said roof structure.

6. The system of claim 5 wherein said batten strip is bonded to said membrane by an adhesive applied continuously along the juncture therebetween to enhance the strength of the composite structure.

7. An element as set forth in claim 5, wherein:

said membrane is approximately six inches (6") wide and 0.045 inches thick; and said batten strip is approximately one inch (1") wide and 0.050 inches thick.

8. A system as set forth in claim 5, wherein:

said elastomeric membrane comprises a reinforced EPDM rubber; and said batten strip is fabricated from a composition of approximately 80–97% by weight of polyethylene terephthalate, and approximately 20—3% by weight of a polyolefin.

9. A system as set forth in claim 5, further comprising:

a roof membrane bonded to said upper surface of said elastomeric membrane, said plastic batten strip, and said roof structure after securement of said composite structure, comprising said batten strip and said elastomeric membrane, to said roof structure by said fasteners.

10. A system as set forth in claim 9, wherein:

said roof membrane comprises non-reinforced EPDM rubber.

11. A coil of a composite roof securement element, comprising:

a coiled membrane of elastomeric material having an outer continuous surface adapted to contact and lie flat upon a roof structure when uncoiled; and a plastic batten strip inseparably bonded to the inner continuous surface of said coiled membrane so as to be disposed on top of said membrane when uncoiled upon said roof structure;

said membrane and said batten strip being sufficiently conjointly flexible so as to lie flat upon said roof structure when uncoiled thereby enabling said membrane and said batten strip to be readily secured to said roof structure by means of fasteners passing through said membrane and said batten strip and into said roof structure.

12. The coil of claim 11, wherein said strip and membrane are secured together by an adhesive applied continuously along the junction therebetween.

13. The coil of claim 11, wherein said membrane is a reinforced EPDM rubber and said batten strip is a composition of from about 80 to 97% by weight of polyethylene terephthalate and from about 3 to 20% by weight of a polyolefin.

14. The coil of claim 11, further comprising:

a plurality of pre-marked points defined upon said batten strip for locating sites at which said fasteners can be inserted through said batten strip and said membrane for insertion into said roof structure.

15. A coil as set forth in claim 11, wherein:

said membrane is approximately six inches (6") wide and 0.045 inches thick; and said batten strip is approximately one inch (1") wide and 0.050 inches thick.

16. The coil as set forth in claim 11, wherein:

said plurality of pre-marked points defined upon said batten strip are defined upon said batten strip by means of pre-punched apertures.

* * * * *